United States Patent [19]

Reed et al.

[11] 3,977,482

[45] Aug. 31, 1976

[54] WIRE LINE CORE BARREL ASSEMBLY

[75] Inventors: Edward W. Reed, North Bay; Edgar J. Sharpe, Thornhill, both of Canada

[73] Assignee: Federal Drilling Supplies Limited, Canada

[22] Filed: Jan. 13, 1975

[21] Appl. No.: 540,705

Related U.S. Application Data

[63] Continuation-in-part of Ser. No. 510,567, Sept. 30, 1974, abandoned.

[30] Foreign Application Priority Data

Oct. 4, 1973 United Kingdom ..... 46319/73
Dec. 17, 1974 Canada ..... 216231

[52] U.S. Cl. ..... 175/246; 294/86.12
[51] Int. Cl.[2] ..... E21B 9/20
[58] Field of Search ..... 175/246, 247, 248, 251, 175/236, 239, 240, 257; 294/86.12

[56] References Cited

UNITED STATES PATENTS

| | | | |
|---|---|---|---|
| 2,148,373 | 2/1939 | Garfield | 175/236 X |
| 2,760,758 | 8/1956 | Yancey et al. | 175/246 |
| 3,103,981 | 9/1963 | Harper | 176/246 X |
| 3,127,943 | 4/1964 | Mori | 175/246 |
| 3,333,647 | 8/1967 | Karich et al. | 175/247 |
| 3,346,059 | 10/1967 | Svendsen | 175/246 |
| 3,441,098 | 4/1969 | Martinsen | 175/246 |
| 3,485,310 | 12/1969 | Milosevich | 175/246 |
| 3,667,558 | 6/1972 | Lambot | 175/246 |

*Primary Examiner*—Ernest R. Purser
*Assistant Examiner*—Richard E. Favreau
*Attorney, Agent, or Firm*—Cushman, Darby & Cushman

[57] ABSTRACT

A wire line core sample retrieval apparatus includes an improved core barrel head assembly having a special lifting collet designed to engage with an overshot. The head assembly includes improved latches and cam means designed to positively retract them when lifting forces are applied to the lifting collet. The overshot includes a special locking collar and associated assembly to provide positive locking engagement with the lifting collet as well as providing easy locking and unlocking of the overshot from said lifting collet either in the well hole or on the surface.

8 Claims, 7 Drawing Figures

WIRE LINE CORE BARREL ASSEMBLY

This application is a continuation-in-part application of the copending U.S. application Ser. No. 510,567, filed Sept. 30, 1974 now abandoned.

This invention relates generally to the art of drilling, particularly to the art of drilling exploratory shafts for sampling subterranean formations. More particularly the invention relates to improvements in apparatus for retrieving a core sample from the bottom of a drilled hole, such apparatus employing a retractable core barrel and head assembly therefor and a detachable retrieval apparatus which is lowered and raised through the drill stem by the use of a wire line hoist. Equipment of this general nature is shown in a number of prior art patents, for example, U.S. Pat. No. 2,829,898 issued Apr. 8, 1958 to Pickard et al.

Attempts have been made through the years to improve the efficiency of these devices both from the operational and maintenatce standpoints. Many prior art devices were found to be susceptible to fouling and sticking of their operating parts after a period of use and breakage of the various return springs used in the latching mechanism was all too common.

It is accordingly a primary object of the invention to provide core recovery apparatus which provides more rapid and easy operation and relatively low maintenance costs with less down-time for maintenance than has been encountered in the various prior art devices.

Thus, one aspect of the invention provides core recovery apparatus comprising a core barrel for receiving and retaining a drill core and a head assembly therefor, the head assembly having an expansible lifting collet connected thereto and a retrieval apparatus adapted to engage with the transmit lifting forces to the head assembly and core barrel, including an overshot assembly including a head member adapted to enter into the expansible lifting collet, the collet and the head member having surface portions designed to permit lifting forces to be transmitted therebetween in the non-expanded condition of the collet, and a locking collar mounted for movement on the overshot assembly between a locking position where said collar closely embraces the lifing collet to prevent expansion thereof and a retracted nonlocking position wherein expansion of the lifting collet and withdrawal of the head member are permitted.

In a further aspect of the invention the overshot assembly includes spring means biasing said locking collar to the locking position.

In a still further aspect of the invention the expansible lifting collet includes a plurality of resilient fingers arranged to assume the non-expanded condition in the absence of radial forces thereon, said head member having means thereon shaped to effect radial expansion of the fingers of the lifting collet during entry of the head member into the lifting collet, with said surface portions of the lifting collet and head member being shaped and arranged to permit the fingers of the lifting collet to assume the non-expanded condition when the head member has fully entered into the lifting collet and thus allow said spring means to move said locking collar to said locking position.

In a still further feature of the invention said locking collar has an annular face portion arranged for engagement by a portion of the lifting collet upon the radial expansion of the latter during the entry of the head member into the lifting collet whereby the locking collar is pushed away from the locking position against the force of the spring means as the head member enters the lifting collet.

A further feature of the invention provides a further collet means on said overshot assembly for releasably holding said locking collar in the retracted position, aand means on the locking collar shaped to engage said collet means after the locking collar has been forced to the retracted position.

A typical embodiment of the invention includes a jar staff connected to the overshot assembly, and a jar tube slidably mounted on the jar staff for delivering impact forces of sufficient magnitude to the overshot assembly when said collar is in the locking position with the head member disposed within the lifting collet as to cause the head member to be forced into the lifting collet an additional distance. The collar and said lifting collet are further constructed and arranged such that as said head member is forced into the lifting collet said additional distance, said collar is pushed by the lifting collet into engagement with said collet means on the overshot assembly and held in the non-locking position thereby to allow the head member to be withdrawn from the lifting collet.

According to a still further feature said locking collar has fluid flow passages therethrough to allow more rapid descent of the overshot head through drilling fluids in a drill hole, and one way valve means on the locking collar adapted to close off said passages when said overshot head is rapidly lifted through the drill hole to enable hydrodynamic forces to build up against the locking collar sufficient to release same from the collet means on the overshot assembly and allow the locking collar to return to the locking position.

In drawings which illustrate an embodiment of the invention:

Figure 1:
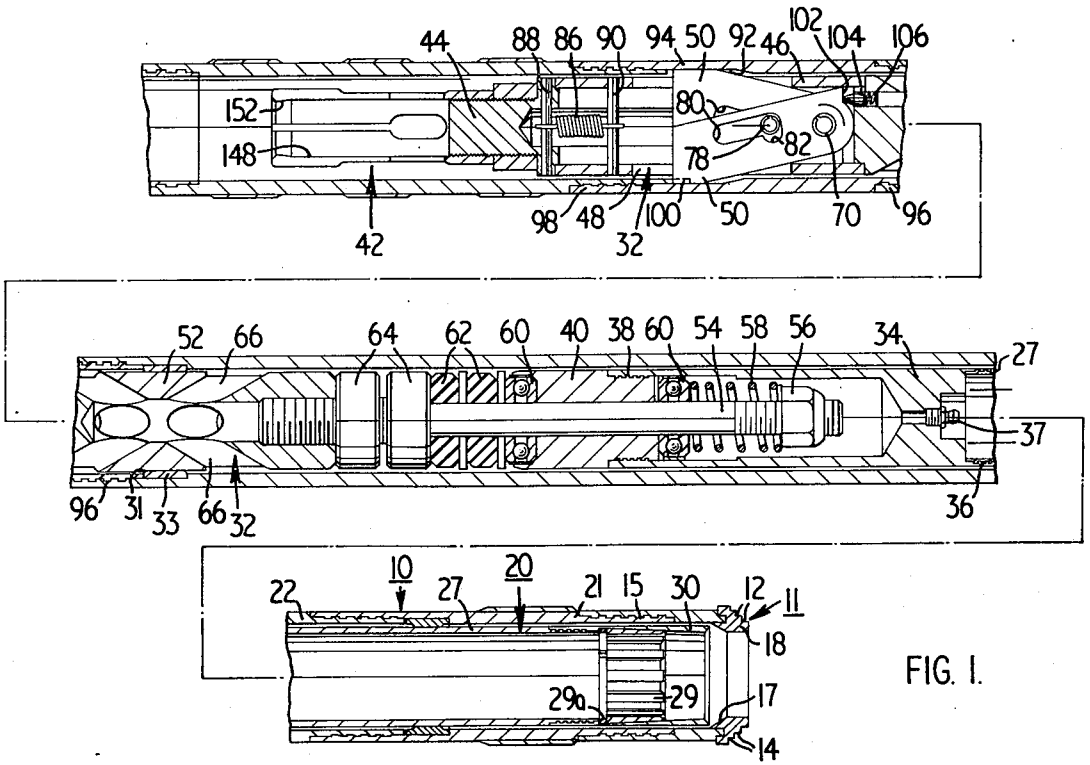
FIG. 1 is a longitudinal sectional view of the lower end of a drill string showing a core barrel and head assembly disposed therein.
Figure 2:
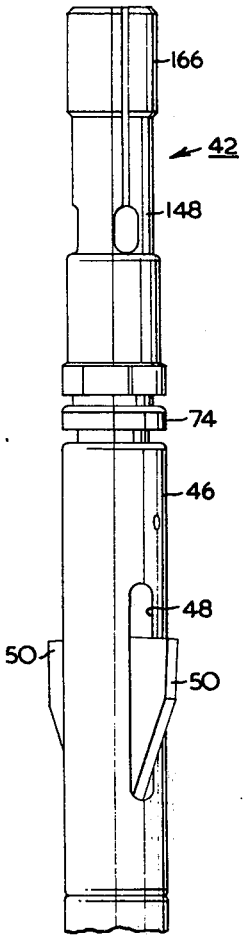
FIG. 2 is an elevation view of the latch case, latch and lifting collet sub-assembly.
Figure 3:
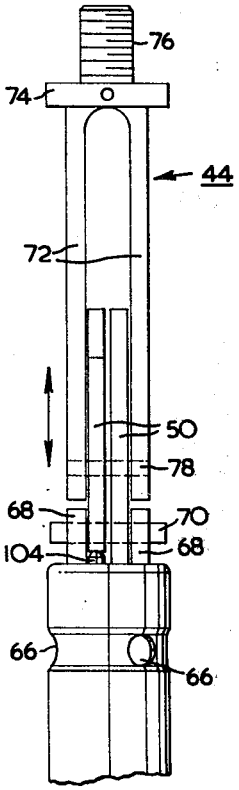
FIG. 3 is an elevation view of the latch spindle, latches and latch body sub-assembly.

With reference to the drawings, particularly FIG. 1, there is illustrated a portion of one embodiment of the invention which includes a hollow drill tube 10 made up of sections of pipe suitably threaded at their opposing ends for coupling same together with a drill bit 11 being located at the lowermost end thereof. In the art, the drill tubes are commonly designated as the "drill stem." Thus the term drill stem will be used herein. The drill stem 10 is hollow and disposed within it at its lower end is a core barrel assembly generally designated by the numeral 20 in which the drill core is received. The head assembly 32 is connected to the upper end of the core barrel assembly 20 and will be described in further detail hereinafter.

As mentioned above, the lowermost end of the drill stem 10 carries the drill bit 11 which in the form here illustrated is a so-called diamond core drill. The cutting surfaces of the diamond core drill are formed by a series of annular faces 12 and a series of sides 14 which are surfaced with diamonds embedded in a hard facing material in the manner well known in the art. It is to be understood that the invention is not limited to diamond core drills but is applicable to all types of hollow core bits such as are conventionally used in taking core samples.

The cutting face of the drill bit is provided with a central aperture or opening 18 through which the core sample, as it is cut, enters into the core barrel assembly 20. The drill bit 11 is threaded at 15 onto a reaming shell 21 which may have diamonds or other hard materials on its outer surface. The reaming shell 21 serves to ream the drill hole to a true diameter. The reaming shell 21 is in turn mounted by screw threads on the outer tube 22 at the bottom of the drill stem 10.

The core barrel assembly 20 fits loosely within the outer tube 22 at the lower end of the drill stem and extends down to a point closely adjacent an inner shoulder 17 formed on the interior of drill bit 11. However, the lower core-receiving end of the core barrel assembly 20 is held free from contact with shoulder 17 by means to be described hereinafter.

The core barrel assembly 20 includes a core receiving inner tube 27 which is provided at its lower end with a core lifter 29 and a core lifter case 30 threaded onto the lower end of the inner tube 27. The core lifter 29 is disposed within the core lifter case 30. The core lifter 29, as is well known in the art, comprises a resilient split spring steel ring having a series of longitudinal ribs around its inner periphery which are adapted to engage and firmly hold the core sample so as to permit breaking off the core and subsequently holding it from falling out of the core barrel assembly as the core barrel assembly is being raised to the surface. As is well known in the art, the lifter ring 29 is tapered on its outer surface and mates with a correspondingly tapered inner surface of the core lifter case 30. Thus, as the core barrel assembly 20 is lifted, the ring 29 moves longitudinally relative to case 30 thus causing the ring 29 to contract and firmly engage the core with the core being thereby pulled and broken free. It is also noted that the inner surface of the core lifter case 30 is provided with a stop ring 29*a* which limits the degree of upward motion of core lifter 29 relative to the case 30.

Core barrel assembly 20 further includes an inner tube cap 34 threaded to the upper end of inner tube 27 at 36. A grease nipple 37 is conveniently provided for injecting lubricants into the interior of the cap to lubricate bearings to be described hereafter. Inner tube cap 34 extends upwardly and is threadably connected at 38 to a bearing cap 40 which forms part of the head assembly 32, the lower end of which assembly is received within the upwardly extending part of tube cap 34.

The main components of the head assembly 32, starting at the upper end of same, are the lifting collet 42 which is connected to the upper end of latch spindle 44, the latter being disposed in a latch case 46 having diametrically opposed slots 48 therein through which opposed latches 50 project. The latch case 46, in turn, is connected to latch body 52. It is also noted here that the latch body 52 is provided with an annular shoulder 31 which rests on a hardened landing ring 33 secured in a recess in the outer tube or casing. The shoulder and landing ring serve to support the head assembly 32 and attached core barrel assembly in the drill stem and allows lifting forces applied to the drill stem to be applied to the core barrel assembly when required. The manner in which the above components co-operate with one another will be described in greater detail hereinafter.

The lower end of latch body 52 is threaded to receive the upper end of an elongated spindle 54 which spindle passes downwardly through the non-rotating bearing cap 40. The lower end of spindle 54 is threaded to receive a tension adjusting nut 56 which bears against a compression spring 58 which maintains a thrust load on the thrust bearings 60 which bear against the lower and upper ends of the non-rotating bearing cap 40. The bearings 60, as those skilled in the art will readily appreciate, permit free rotation of the head assembly with the drill stem while allowing bearing cap 40 and the entire core barrel assembly 20 to remain non-rotative during a drilling operation. Disposed just above the upper thrust bearing 60 are a pair of thick rubber water shut-off valves 62 having metal washers therebetween. The first of a pair of threaded jam nuts 64 ensures that the spindle 54 remains firmly threaded in the lower end of the latch body 52 while the other counteracts upward thrusts transmitted through the shut-off valves 62.

As is well known in the art, when drilling has proceeded to a point such that the core receiving inner tube 27 is filled with the core, the upper end of the core bears against the lower end of the inner tube cap and the upward thrust force is transmitted through the non-rotating bearing cap 40 and compresses the rubber shut-off valves so that their outer peripheries contact the inner surface of the outer casing of the drill stem 10 thus cutting off the flow of drilling fluid and causing a rapid rise in pressure which is detected at the surface by suitable means well known in the art. The core can then be broken free by lifting up on the drill stem with those forces being transmitted to the head assembly 32 via the above mentioned shoulder 31 and landing ring 33 and thence through the above described spindle assembly to the core barrel assembly. The lifting action on the inner tube 27 effects contraction of the lifter ring 29, causing it to grip the core to lift and break same free from the earth formation. The core is then free to be lifted upwardly through the drill string as will be described hereinafter.

The head assembly 32 will now be described in greater detail with particular reference to latch body 52, latch case 46, latches 50, latch spindle 44 and lifting collet 42. The lower part of the latch body is provided with a series of passages 66 therein which serve to allow the drilling fluid to by-pass the mating shoulder 31 on the latch body and the landing ring 33 on the drill stem. The upper end of latch body 52 is provided with a pair of spaced upwardly extending lugs 68 through which a latch pivot pin 70 extends. Pin 70 is sufficiently long that it also extends through suitable openings in the lower end of the hollow latch case 46 thereby to connect the latch case to the latch body. The two scissor-type latches 50 are pivoted at their lower ends on pin 70 and are disposed intermediate the spaced lugs 68. The latch spindle 44 which is mainly disposed in the latch case 46 includes spaced apart legs 72 defining a slot therebetween sufficiently wide as to allow free scissor-type motion of the two latches 50. The upper end of the latch spindle has a collar 74 thereon and above the collar is an externally threaded portion 76 which engages the lower end of the lifting collet 42. Adjacent the lower ends of the legs 72 of the latch spindle is a camming pin 78 which extends through both legs 72 and through elongated cam slots 80 which extend longitudinally of both of the latches 50. Each camming slot 80 includes a recess 82 at its lower end at right angles to its associated cam slot 80 to allow for complete retraction of the latches 50 into the latch case even when the camming pin 78 is in the lower position. In order to retract latches 50 into the latch case, the latch spindle 44 is movable axially relative to the latch case 46 in response to lifting forces on lifting collet 42. Thus, when a lifting force is applied to collet 42, the latch spindle is drawn part way out of the latch case 46 with cam pin 78 moving upwardly within the cam slots 80 and providing for a positive release action of the latches 50. When the cam pin 78 reaches the top of the cam slots 80 the latches are fully retracted into the latch case and further lifting of the lifting collet transmits lifting forces through the latches, through latch pivot pin 70 and thence to the latch body 52 and causes the entire head assembly 32 and attached core barrel assembly to be lifted upwardly. In order to fully retract the latch spindle into the latch case 46 and to permit extension of the latches when lifting forces are released a coil tension spring 86 is provided which is connected at one end to a pin 88 which passes through the collar 74 on the latch spindle 44, and at the other end to a pin 90 which passes through the upper end portion of latch casing 46.

It will be appreciated that the function of the latches is to transmit the rotary motion of the drill stem to the head assembly 32. To provide for this action, the inner surface of the drill stem tube is machined at region 92 to allow the latches to extend outwardly a substantial distance beyond the outer circumference of the latch case 46. To facilitate this machining operation, the drill stem includes a relatively short section 94 in the region of the latches which is threaded to the drill stem sections above and below it at threaded joints 96 and 98. The lowermost end of the drill stem section just above section 94 includes a short downwardly extending drive lug 100 which is located in the machined out portion 92 referred to above. The latches 50, when extended, are so arranged that the outermost surfaces of same are generally flush with this machined out portion and thus one of the latches 50 is engaged by the drive lug 100 and a torsional force applied thereto to effect rotation of the head assembly 32 during drilling. The above mentioned slots in the latch casing are dimensioned so that a substantial portion of this force is taken up by the latch casing thus avoiding undue torsional strain on the latch spindle 44, and on the camming pin and latch pin 78 and 70 respectively.

In order to ensure that the latches 50 are constantly biased outwardly of the latch casing to engage drive lug 100 when the latch spindle 44 has been fully retracted into the latch case 46 by spring 86, each latch is provided, adjacent its pivot point with a shoulder 102 against which shoulder a latch plunger 104 bears, plungers 104 being constantly urged against shoulders 102 by coil compression springs 106, thus urging latches 50 outwardly of the latch casing in the direction shown by the arrow. Since the springs 106 are fully enclosed in the latch body damage to or fouling of the springs is largely eliminated. Thus, by virtue of the structure described above, positive retraction of the latches is assured when it is desired to pull the core, and the outward biasing of the latches ensures positive engagement thereof with the driving lug 100 during drilling operations.

Figure 4:
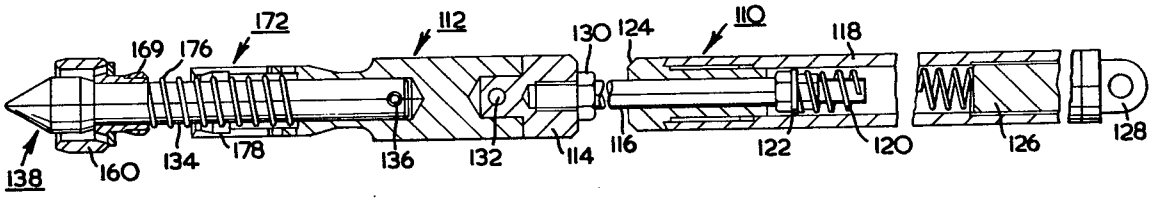
FIG. 4 is a longitudinal section of the retrieval assembly including the overshot head and jar tube assemblies.
Figure 5:
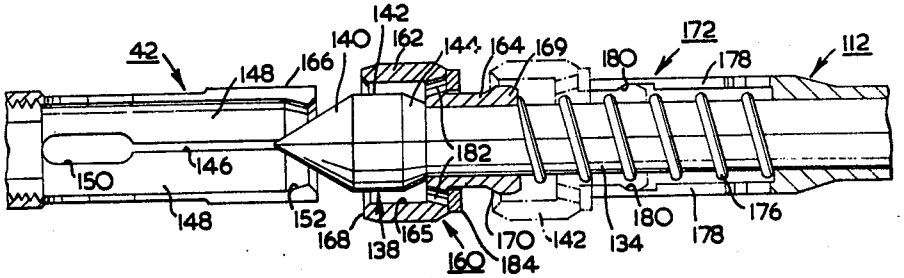
FIG. 5 is a longitudinal section view illustrating the manner of cooperation between the lifting collet and the head and locking collar of the overshot head.

As noted previously the lifting collet 42 is secured to the upper end of the latch spindle 44 so that when a lifting force is applied thereto the latches 50 are retracted to enable the head assembly 32 and attached core barrel 20 to be retrieved. Although the lifting collet 42 forms a part of the head assembly, its structure and function will be more clearly understood by describing it in conjunction with the overshot or retriever assembly 110 shown in FIGS. 4 – 6. It will be seen that the overshot assembly 110 includes an overshot head 112 connected via coupling 114 to an elongated jar staff 116. The jar staff 116 is slidably mounted within an elongated jar tube 118 and is provided with an elongated coil compression spring 120 which bears against the upper closed end of such tube 118 and also against a washer and nut assembly 122 mounted on the jar staff 116 thus urging the jar staff outwardly of the end of the jar tube, assembly 122 also functioning as a guide for the inner end of the jar staff 116. The lower end of the jar tube is provided with a block or hammer portion 124 having an aperture therethrough to permit free sliding of jar staff 116 relative to the jar tube. The opposite end of the jar staff is provided with a swivel block 126 to which a swivel 128 is connected. The wire line hoist cable is connected to the swivel in the usual fashion. As those skilled in the art will appreciate, a length of steel bar of "sinking tube" (not shown) may be interfitted between the jar tube and the swivel in order to provide the jar tube assembly with the desired amount of weight.

The jar staff 114 is threaded into the coupling 114 of overshot head 112 with a lock nut 130 on the jar staff 116 bearing against coupling 114 and preventing accidental disengagement of the jar staff 116 from coupling 114. In addition, lock nut 130 serves to transmit impact blows delivered by hammer 124 on the jar tube to the overshot head 112. It is also noted here that the coupling 114 is preferably secured to the body of the overshot head by a shear pin 132 which breaks in the event that jamming occurs during lifting of the core thus avoiding breakage of the hoist cable in the hole and the problems that would be encountered if it became necessary to pull the drill string with a length of borken cable in the lower end of same.

The opposite end of the overshot head 112 has mounted therein a longitudinally extending cylindrical shaft 134 which is snugly secured in the overshot head by means of a lock pin 136. The outer end of shaft 134 is provided with an enlarged head 138, the latter including a conical tip 140, a cylindrical intermediate portion 142 adjacent the tip 140, and a bevelled shoulder 144. Head 138 is designed to enter into the lifting collet 42 and thus, the latter is designed to expand to receive the head 138 and to thereafter contract to allow a locking collar 142 to advance over the end of the lifting collet 42 and prevent expansion thereof when a lifting force is applied to head 138. To provide this function, the lifting collet 42 has several, preferably four, longitudinally extending slots 146 therein which serve to sub-divide the collet 42 into four elongated arcuate sections or fingers 148. At the root of each slot there is provided an elongated recess 150 which recesses serve to assist in providing the desired degree of resiliency or flexibility of the collet fingers 148. The free end of collet 42 is machined to provide each collet finger with an inwardly directed shoulder 152 which is bevelled to match the bevelled shoulder 144 on head 138. Slidably mounted on shaft 134 is a locking collar 160. Locking collar 160 includes a cup shaped body 162 and a sleeve portion 164 integrally connected thereto, the sleeve portion being bored to receive the shaft 134. Sleeve portion 164 also includes an enlarged end portion 169 having an outwardly flaring bevelled annular surface 170 designed to engage with an overshot head collet 172, and a rounded or bevelled free end portion 174 designed to provide for ease of entry of the sleeve portion of the locking collar 160 into the overshot head collet. The inside diameter of surface 165 of collar 160 is made just slightly greater than the outside diameter of the free end portion 166 of lifting collet 42. Collar 160 also includes a forwardly directed annular face portion 168, the function of which will be apparent from the description which follows.

A coil compression spring 176 disposed around the shaft 134 continually urges the locking collar toward the head 138 and thus the locking collar 160 is normally positioned adjacent the head 138 with its cup-shaped portion encompassing the head. At the same time, this spring is sufficiently compressible as to allow the locking collar to be gripped or held in the retracted position shown by the dashed lines in FIG. 5 by the overshot head collet 172.

The overshot head collet 172 is much the same in structure as lifting collet 42, i.e., it includes a plurality of longitudinally extending slots therein which define angularly spaced apart collet fingers 178 which are sufficiently resilient as to permit them to be sprung radially outwardly and permit entry of the enlarged end portion 169 of the locking collar 160 into the overshot collet upon application of a suitable impact blow on the overshot head 112. When this occurs, the locking collar 160 is firmly gripped in the retracted non-locking position by virtue of the engagement of the inwardly directed bevelled surfaces 180 on the overshot head collect fingers which mate with and engage the above mentioned bevelled annular surface 170 on the locking collar 160.

Another feature of the locking collar 160 concerns the fact that the cup shaped portion of same is provided with a plurality of closely spaced passage ways 182 therethrough. A heavy metal ring 184 is mounted to have free sliding movement on the sleeve portion 164 and in one position closely adjacent the ends of passageways 182 serves to close off the passageways 182 while in another position spaced therefrom it serves to permit flow of drilling fluid through the locking collar, i.e., ring 184 serves as a one-way valve; the advantage associated with this will be apparent from the following description of the operation of the device.

Figure 7:
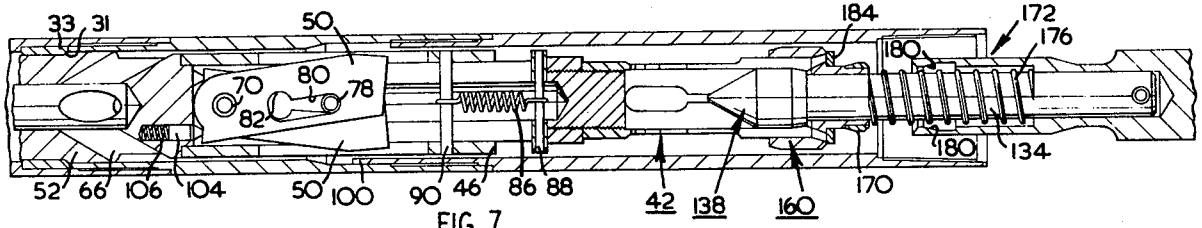
FIG. 7 is a longitudinal section of a portion of the drill stem showing the overshot head engaged with the lifting collet, the latches of the core barrel head assembly being in the retracted position.

It will be assumed that drilling has progressed to the point where the drill core has reached the top of the core barrel inner tube 27 and that the core has been broken free as described previously. The retrieval assambly including overshot assembly 110 and jar staff and tube assembly attached to the wireline hoist are allowed to free fall into the drill string to a point about 10 feet above the lifting collet 42. The retrieval assembly is then lowered somewhat more slowly so that the conical tip 140 of the head 138 enters into the free upper end of the lifting collet 42 thus spreading the fingers of same radially outwardly. As the head 138 enters further into the lifting collet 42 the free ends of the collet fingers contact the annular face of the locking collar 160 thus causing it to slide upwardly along shaft 134 while compressing the coil spring 176. However, when the head 138 is fully inside the lifting collet 42 the fingers contract radially so that their inwardly directed shoulders 152 engage behind the bevelled shoulder 144 on head 138, thus releasing the locking collar 160 which is forced downwardly by compression spring 176 into the locked position shown in FIG. 7. In the locked position, the locking collar embraces the fingers 148 of the lifting collet 42 and prevents them from spreading outwardly; thus the head 138 is firmly and positively secured in the lifting collet 42 and, by lifting upon the hoist, the entire retrieval assembly together with the head assembly and core barrel assembly can be drawn outwardly from the hole. (The manner in which the latches 50 disengage when a lifting force is applied to the lifting collet 42 has already been described and need not be repeated here).

Figure 6:
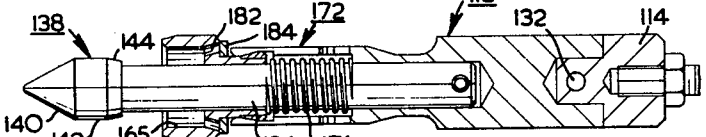
FIG. 6 is a further longitudinal section of the overshot head showing the locking collar held in the retracted non-locking position.

It is a simple matter to disengage the retrieval assembly from the head assembly either on the surface after a core has been raised, or down in the hole. The driller simply lifts up on the jar tube and lowers it rapidly so as to apply an impact force to the overshot head 112. This action forces the head 138 deep enough into the lifting collet as to allow the overshot head collet 172 to engage the enlarged end portion 169 of the locking collar thus holding the locking collar 160 firmly as the overshot head is moved upwardly to free the locking collar from the lifting collet. The fingers 148 of the lifting collet 42 are then free to expand outwardly and the head 138 of the overshot may easily be withdrawn from the lifting collet thus freeing the retrieval assembly from the core barrel and head assemblies. Since the locking collar 160, at this point, is in the retracted position as seen in FIG. 6 it is necessary to apply an external force thereto to release it from the overshot head collet 172 before further locking engagement with the lifting collet 42 can take place. This can be done, on the surface, by applying forces to the locking collar 160 manually or with a suitable tool. In the hole, it sometimes happens that the overshot assembly is accidentally dropped onto head assembly so rapidly that the head 138 enters too deep into the lifting collet 42 and the locking collar 160 is driven so far back that it becomes engaged with the overshot collet 172, thus holding the locking collar in the retracted position. Hence, in this condition, lifting of the core barrel assembly and head assembly cannot be effected. Prior art devices usually required that the retrieval assembly be hoisted to the surface, a rather time consuming operation, but with the device shown, this operation can usually be eliminated. Reference has been made above to the spaced passageways 182 in the locking collar and the ring 184 cooperating therewith to form a one-way valve. When the retrieval assembly is being lowered into the hole through the water or drilling fluid in the hole, the flow of such fluid through passageways 182 actually allows the retrieval assembly to drop more rapidly than if the holes were absent. Conversely if the retrieval assembly is hoisted rapidly, ring 182 closes these passages and thus a considerable hydrodynamic pressure is created on the upper side of the locking collar. This pressure will free the locking collar 160 from the overshot head collet 172 if the hoisting speed is sufficient, thus enabling the driller to make a further attempt at retrieval. The driller is more apt to be successful on the second attempt because he will have noted the exact depth of the core barrel, et., on the first attempt and thus will have a better idea as to how far the retrieval assembly should be allowed to free fall before reducing its speed some 10 feet above the head assembly to a value which will ensure that the retrieval assembly has just sufficient momentum as to allow proper locking engagement of the overshot head with the lifting collet 42. The above described operation provides a considerable time saving in that only 100 feet or so of cable need be lifted to re-set the retrieval mechanism compared with the length of cable (often 1000 to 3000 feet or more) that would have to be withdrawn if it were necessary to pull the retrieval mechanism to the surface in order to manually release the locking collar from the overshot head collet to enable it to effect locking engagement with the head assembly of the core barrel.

We claim:

1. Core recovery apparatus comprising a core barrel for receiving and retaining a drill core and a head assembly therefor, the head assembly having an expansible lifting collet connected thereto and a retrieval apparatus adapted to engage with and transmit lifting forces to the head assembly and core barrel, including an overshot assembly, the overshot assembly including a head member adapted to enter into the expansible lifting collet, the collet and the head member having surface portions designed to permit lifting forces to be transmitted therebetween in the non-expanded condition of the collet, and a locking collar mounted for movement on the overshot assembly between a locking position where said collar closely embraces the lifting collet to prevent expansion thereof and a retracted non-locking position wherein expansion of the lifting collet and withdrawal of the head member are permitted.

2. Apparatus according to claim 1 wherein said overshot assembly includes collet means for holding said locking collar in the retracted position, and spring means biasing said locking collar to the locking position.

3. Apparatus according to claim 1 wherein the overshot assembly includes spring means biasing said locking collar to the locking position.

4. Apparatus according to claim 3 wherein the expansible lifting collet includes a plurality of resilient fingers arranged to assume the non-expanded condition in the absence of radial forces thereon, said head member having means thereon shaped to effect radial expansion of the fingers of the lifting collet during entry of the head member into the lifting collet, with said surface portions of the lifting collet and head member being shaped and arranged to permit the fingers of the lifting collect to assume the non-expanded condition when the head member has fully entered into the lifting collet and thus allow said spring means to move said locking collar to said locking position.

5. Apparatus according to claim 4 wherein said locking collar has an annular face portion arranged for engagement by a portion of the lifting collet upon the radial expansion of the latter during the entry of the head member into the lifting collet whereby the locking collar is pushed away from the locking position against the force of the spring means as the head member enters the lifting collet.

6. Apparatus according to claim 5 further including a jar staff connected to the overshot assembly, and a jar tube slidably mounted on the jar staff for delivering impact forces of sufficient magnitude to the overshot assembly when said collar is in the locking position with the head member disposed within the lifting collet as to cause the head member to be forced into the lifting collet an additional distance, the collar and said lifting collet being further constructed and arranged such that as said head member is forced into the lifting collet said additional distance, said collar is pushed by the lifting collet into engagement with said collet means on the overshot assembly and held in the non-locking position thereby to allow the head member to be withdrawn from the lifting collet.

7. Apparatus according to claim 5 including a further collet means on said overshot assembly for releasably holding said locking collar in the retracted position, and means on the locking collar shaped to engage said collet means after the locking collar has been forced to the retracted position.

8. Apparatus according to claim 7 wherein said locking collar has fluid flow passages therethrough to allow more rapid descent of the overshot head through drilling fluids in a drill hole, and one way valve means on the locking collar adapted to close off said passages when said overshot head is rapidly lifted through the drill hole to enable hydrodynamic forces to build up against the locking collar sufficient to release same from the collet means on the overshot assembly and allow the locking collar to return to the locking position.

* * * * *